US006552695B1

(12) United States Patent
Strickland

(10) Patent No.: US 6,552,695 B1
(45) Date of Patent: Apr. 22, 2003

(54) SPIN-SCAN ARRAY

(75) Inventor: Peter C. Strickland, Ottawa (CA)

(73) Assignee: EMS Technologies Canada, Ltd., Ottawa (CA)

( * ) Notice: Subject to any disclaimer, the term of this patent is extended or adjusted under 35 U.S.C. 154(b) by 0 days.

(21) Appl. No.: 10/079,914

(22) Filed: Feb. 22, 2002

(51) Int. Cl.[7] ..... H01Q 1/36
(52) U.S. Cl. ..... 343/895
(58) Field of Search ..... 343/766, 853, 343/878, 882, 895; H01Q 1/36

(56) References Cited

U.S. PATENT DOCUMENTS

| | | | | |
|---|---|---|---|---|
| 3,673,606 A | | 6/1972 | Maune | |
| 4,427,984 A | | 1/1984 | Anderson | |
| 4,954,832 A | | 9/1990 | Grant et al. | |
| 5,025,262 A | | 6/1991 | Abdelrazik et al. | |
| 5,146,235 A | * | 9/1992 | Frese | 343/895 |
| 5,345,248 A | * | 9/1994 | Hwang et al. | 343/895 |
| 5,432,524 A | | 7/1995 | Sydor | |
| 5,451,974 A | * | 9/1995 | Marino | 343/895 |
| 5,612,707 A | | 3/1997 | Vaughan et al. | |
| 6,198,449 B1 | * | 3/2002 | Muhlhauser et al. | 343/753 |
| 6,243,052 B1 | * | 6/2002 | Goldstein et al. | 343/895 |
| 6,407,714 B1 | * | 6/2002 | Butler et al. | 343/766 |

FOREIGN PATENT DOCUMENTS

| | | |
|---|---|---|
| WO | WO 96/19846 | 6/1996 |

* cited by examiner

*Primary Examiner*—Tho Phan
(74) *Attorney, Agent, or Firm*—Dennis R. Haszko; Robert A. Wilkes; Robert G. Hendry

(57) ABSTRACT

A phased-array antenna whose main beam can be positioned (scanned) substantially anywhere within a full hemispherical coverage. The phased-array antenna consists of a plurality of radiating multi-filar helix antenna elements, each of which is independently rotatable on its helix axis relative to the antenna base plane. The rotation of each radiating element substantially decreases the noise temperature, the passive intermodulation of signals, and the sidelobe levels relative to an antenna which uses PIN diode phase shifters. A change in the radiated signal phase of each element in the antenna array is achieved by the mechanical rotation of the multi-filar helical antenna element on its axis. Mechanical rotation is provided by a drive system or multiple drive systems coupled to at least one radiating antenna element. The drive system rotates the at least one radiating element on its axis by various amounts. The amount of rotation is directly proportional to the amount of phase shift required of that particular multi-filar helical antenna element relative to the other antenna elements.

19 Claims, 6 Drawing Sheets

SPIN-SCAN ARRAY

FIELD OF THE INVENTION

The present invention relates to a phased-array antenna consisting of multiple radiating elements where at least one of the radiating antenna elements is rotatable on its axis. More particularly, the invention relates to an antenna array of multi-filar helical antenna elements which are individually rotated to control the phase of the antenna array.and thereby steer the beam of the antenna system.

BACKGROUND OF THE INVENTION

In satellite communications, airborne antennas serve multiple purposes such as providing voice communications to the cockpit and the cabin of the aircraft, data and Internet services, and more recently, real-time video streaming. Such antennas are required to have low noise temperature and a compact size to minimize the drag on the aircraft. For certain applications, a small footprint is required for the antenna system.

For transmission and reception over various global networks, an aircraft requires an antenna beam that can track satellites effectively. The antenna beam must be capable of being directed towards various satellites regardless of aircraft orientation. Various types of high gain antennas such as a mechanically steered antenna, a switched beam antenna, or a phased-array antenna, can provide this functionality.

Mechanically steered antennas are usually mounted inside the tail section of an aircraft where the height limitations on the antennas are not as important. However, gaining access to the tail of a larger aircraft is often quite difficult, due in part to the height of the tail and also in part to the weight of the radome where the antenna is placed. Such constraints limit the access to antennas located inside the tail of an aircraft.

Another option available for antenna beam steering is the use of switched beam antennas. Unfortunately, switched antenna beams suffer from low gain at the beam cross-over points and a large phase discontinuity when beams are switched.

The phased-array antenna, on the other hand, offers distinct advantages. The phased-array antenna consists of a group of radiating elements which are distributed and oriented on a planar surface in various spatial configurations. Depending on the amplitude and phase excitation of each radiating element, the resulting antenna beam can be controlled. Phased-array antennas, which may have a low profile design, are normally mounted on top of the fuselage of an aircraft. Conventional phased-array antennas usually experience losses in gain and an undesirable increase in sidelobe levels, resulting from the quantization of the phase settings of the antenna elements. Typically, these conventional phased-array antennas employ switched phase shifters. Such conventional switched phase shifters usually have a minimum phase step size of approximately 22.5 or 45°. The 22.5° step size is a considerable phase shift and as a result a remnant phase discontinuity is introduced when the beam is scanned from one position to the next and the resolution in angular pointing is finite. It is highly desirable to provide an antenna array system where the phase settings are not quantized and where the phase error for each antenna element can be maintained within a fraction of a degree.

Conventional phased-array antennas typically use positive-intrinsic-negative (PIN) diode phase shifters. In a phased-array antenna, most antenna radiating elements have their own dedicated phase shifter. The phase shifter permits the radiated power for each antenna element to be adjusted over a +/−180 degree range relative to the other antenna elements. Unfortunately, the discrete stepping of the phase angle results in some degree of phase error relative to the ideal phase of the antenna element. This phase error results in increased sidelobe levels and reduced gain, and affects the direction of the antenna beam. The spreading and squinting of the antenna beam and their attendant gain losses are significant hindrances in airborne applications. Furthermore, the dissipative loss of the phase shifter's reduces the antenna gain and also increases the antenna noise level, usually referred to as the antenna noise temperature.

The present invention seeks to overcome the above shortcomings by providing a phased-array antenna system with a narrow beam. Furthermore, the antenna beam coverage is increased through use of multi-filar helix antenna elements which are each rotatable on their axes in order to change the angular orientation of the antenna beam. The present invention does not require the use of phase shifters to achieve phase control, thereby minimizing the phase errors and gain losses introduced by such shifters.

SUMMARY OF THE INVENTION

The present invention seeks to provide a phased-array antenna whose main beam can be positioned (scanned) substantially anywhere within a full hemispherical coverage. The phased-array antenna consists of a plurality of radiating multi-filar helix antenna elements, each of which is independently rotatable on its helix axis relative to the antenna base plane. The rotation of each radiating element substantially decreases the noise temperature, the passive intermodulation of signals, and the sidelobe levels relative to an antenna which uses PIN diode phase shifters. A change in the radiated signal phase of each element in the antenna array is achieved by the mechanical rotation of the multi-filar helical antenna element on its axis. Mechanical rotation is provided by a drive system or multiple drive systems coupled to at least one radiating antenna element. The drive system rotates the at least one radiating element on its axis by various amounts. The amount of rotation is directly proportional to the amount of phase shift required of that particular multi-filar helical antenna element relative to the other antenna elements.

In an alternative embodiment, there is provided a phased-array antenna consisting of a plurality of radiating multi-filar helix antenna elements, together with a plurality of drive systems with each drive system coupled to a multi-filar helix element. The amount of rotation required for each helix element is determined by the position of each element relative to the other elements in the array and the desired antenna beam angle. Thus, the amount of rotation for each element provided by each of the drive systems varies according to the design specification.

In a first aspect, the present invention provides an antenna system including:

(a) a base;

(b) at least one stationary multi-filar helical antenna element, the or each stationary multi-filar helical antenna element having a longitudinal axis, the or each stationary multi-filar helical antenna element having a first feed network coupled to a base end of the stationary antenna element, the first feed network having a feed end located at the base end of.a corresponding stationary antenna element;

(c) at least one rotatable multi-filar helical antenna element, the or each rotatable multi-filar helical antenna element having a longitudinal.axis, the or each rotatable multi-filar helical antenna element having a second feed network coupled to a base end of the antenna element, each second feed network having a feed end located at the.base end of a corresponding rotatable antenna element, wherein the or at least one rotatable multi-filar helical antenna elements is rotatable on its longitudinal axis;

(d) at least one drive system connected to a corresponding one of the at least one rotatable multi-filar helical antenna elements, the at least one drive system being capable of rotating the corresponding at least one of the rotatable helical antenna elements about its longitudinal axis;

(e) a power, splitting and combining means for feeding input power to each feed network belonging to each of the at least one stationary multi-filar helical antenna elements and the at least one rotatable multi-filar helical antenna element;

wherein the or each stationary antenna element is supported by the base at the base end of the stationary antenna element, wherein the or each rotatable antenna element is supported by the base at the base end of the rotatable antenna element, and wherein the power splitting and combining means feeds input power to the feed end of each first feed network and the feed end.of.each second feed network.

In a second aspect, the present invention provides an antenna system including:

(a) a base;

(b) at least one stationary monofilar helical antenna element, the breach stationary monofilar helical antenna element having a longitudinal axis, the or each stationary monofilar helical antenna element having a first feed network coupled to a base end of the stationary antenna element, the first feed network having a feed end located at the base end of a corresponding stationary antenna element;

(c) at least one rotatable monofilar helical antenna element, the or each rotatable monofilar helical antenna element having a longitudinal axis, the or each rotatable monofilar helical antenna element having a second feed network coupled to a base end of the antenna element, each second feed network having a feed end located at the base end of a corresponding rotatable antenna element, wherein the or at least one rotatable: monofilar helical antenna elements is rotatable on its longitudinal axis;

(d) at least one drive system connected to a corresponding of the at least one rotatable monofilar helical antenna elements, the at least one drive system being capable of rotating the corresponding at least one of the rotatable helical antenna elements about its longitudinal axis;

(e) a power splitting and combining means for feeding input power to each feed network belonging to each of the at least one stationary monofilar helical antenna elements and the at least one rotatable monofilar helical antenna element;

wherein the or each stationary antenna element is supported by the base at the base end of the stationary antenna element, wherein the or each rotatable antenna element is supported by the base at the base end of the rotatable antenna element, and wherein the power splitting and combining means feeds input power to the feed end of each first feed network and the feed end of each second feed network.

BRIEF DESCRIPTION OF THE DRAWINGS

The invention will now be described with reference to the drawings, in which.

DETAILED DESCRIPTION

Figure 1:
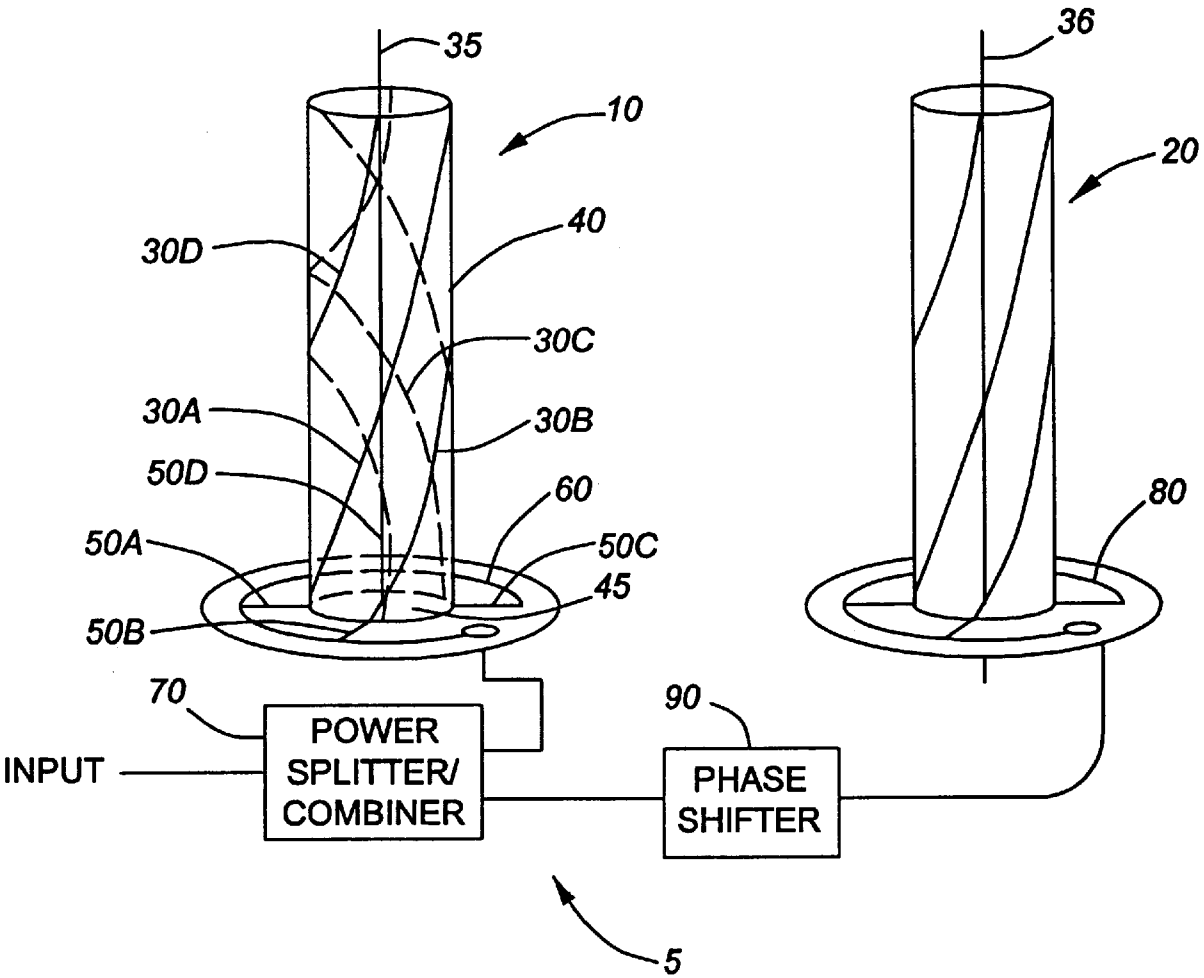
PRIOR ART FIG. 1
FIG. 1 shows a conventional phased-array of multi-filar helical antenna elements according to the prior art.

FIG. 1 illustrates a conventional phased-array antenna 5 according to the prior art. There are two multi-filar helical antenna elements 10, 20 shown. It is preferable to use multi-filar helical antenna elements in a phased-array antenna but in other conventional techniques the radiating elements chosen may be non-helical radiating elements. The two multi-filar helical antenna elements 10, 20 are quadrifilar helical antenna elements with four conductive filaments 30A, 30B, 30C, 30D, in one quadrifilar helical antenna element 10. The antenna element 10 has a longitudinal axis 35 about which the conductive filaments 30A, 30B, 30C, 30D are wound in a nominally helical trajectory. The antenna element 20 also has a longitudinal axis 36. Each filament 30A, 30B, 30C, 30D, is arranged as a helix around a support tube 40. The helix winding determines the radiating pattern of the quadrifilar helical antenna element 10. Around a base 45 of the helix support tube 40 is an origin end for each filament 30A, 30B, 30C, 30D. At the base 45 of the helix support tube 40 are four separate filament feeds 50A, 50B, 50C, 50D for each of the filaments 30A, 30B, 30C, 30D respectively. Each of the feeds is a conductive element, such as electrical wire or strip and each is coupled to an antenna feed network.

As shown in FIG. 1, each filament antenna feed 50A, 50B, 50C, 50D form part of the antenna feed network 60. The feed network 60 excites the four conductive filaments 30A, 30B, 30C, 30D through the filament antenna feeds 50A, 50B, 50C, 50D. The second quadrifilar helical antenna element 20 has a similar winding structure as the first quadrifilar helical antenna element 10.

Both the first and the second quadrifilar helical antenna elements 10, 20 are connected to a power splitter/combiner 70. The first quadrifilar helical antenna element 10 is directly coupled to the power splitter using the feed network 60. The phase shifter 90 is coupled between the feed network 80 and the power splitter 70. A phase shifter shifts the phase of the signal received or transmitted from a given element relative to the phase of a signal received or transmitted by other elements in the array. The phase shifter 90 is responsible for shifting the phase of the signal received or transmitted by the second multi-filar helical antenna element 20 relative to the phase of the signal received or transmitted by the first multi-filar helical antenna element 10. In the case of transmission, the power splitter/combiner 70 evenly distributes the input power, derived from a power source (not shown), to both radiating multi-filar helical antenna elements 10, 20. For reception, the power splitter/combiner combines the signals received from both the first and the second multi-filar helical antenna elements 10, 20 and transmits the combined signal to a receiver (not shown).

Figure 2:
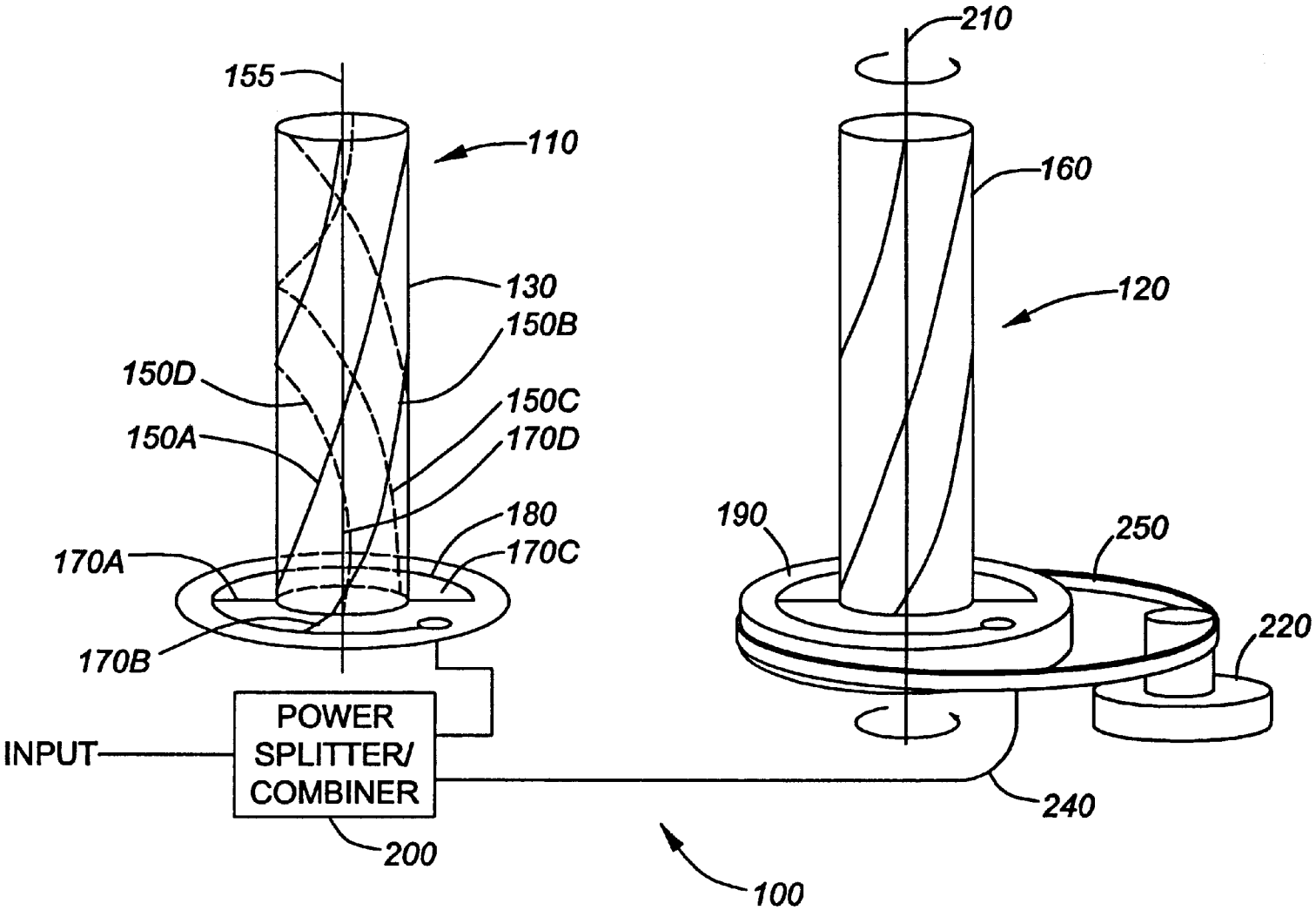
FIG. 2 shows two multi-filar helical antenna elements with.one element being rotatable on its axis according to a first embodiment of the present invention.

FIG. 2 illustrates a one-dimensional phased-array antenna 100 according to a first embodiment of the present invention. The antenna array consists of two multifilar helical elements 110, 120. It should be mentioned that the use of multifilar helical antenna elements in the antenna array is the preferred embodiment of the present invention. An element pattern is essentially the coverage of individual elements. The composite beam of the full antenna array (radiation pattern) is constrained to fall within the element patter coverage. A broad element pattern is advantageous as it allows the main antenna beam of the phased-array antenna to scan over a correspondingly broad range. Therefore it is preferable that quadrifilar helical antenna elements be utilized in a the applications considered here. Accordingly, the two multifilar helical antenna elements 110, 120 depicted in FIG. 2 are quadrifilar helical antenna elements.

The quadrifilar helical antenna elements 110, 120 of the present invention are similar to those described in FIG. 1. The difference between the phased-array antenna 5 in FIG. 1 and the phased-array antenna 100 in FIG. 2 is that the first quadrifiiar helical antenna element 110 in FIG. 2 is stationary while the second quadrifilar helical antenna element 120 is rotatable. In FIG. 1, neither of the antenna elements are rotatable. The first quadrifilar helical antenna element 110 has a support tube 130 which supports the four conductive filaments 150A, 150B, 150C, 150D. The conductive filaments 150A, 150B, 150C, 150D are wound about a common helical axis 155. The conductive filaments 150A, 150B, 150C, 150D are wound in a nominally helical trajectory. Each conductive filament 150A, 150B, 150C, 150D has an axial length of less than one free space wavelength at the minimum operating frequency of the helical antenna element. Although the support structure 130 is a cylindrical tube there are other possible designs which would support the filament in a helical winding. A crossed-board structure for a helical antenna element as that disclosed in U.S. Pat. No. 6,181,298, may be utilized as a support structure. The second multi-filar helical antenna element 120 has its own support tube 160 and its own set of four conductive filaments similar to that for the first quadrifilar helical antenna element 110. The axial length of each quadrifilar helical antenna element may vary but it is preferable that this length be less than one wavelength of the signal to be transmitted or received in order that the antenna be compact and have a broad scan range. At the base of the first quadrifilar helical antenna element 110 are the filament antenna feeds 170A, 170B, 170C, 170D for each of the four filaments 150A, 150B, 150C, 150D. The filament antenna feeds 170A, 170B, 170C, 170D are part of the antenna feed network 180. As explained previously, the feed network 180 excites the various filaments in the quadrifilar helical antenna element 120. In the case of a quadrifilar helical antenna element, the four filaments 150A, 150B, 150C, 150D are preferably excited with equal current magnitudes and relative phases of 0, 90, 180, and 270°, respectively. As such, one of the four filaments is used as a reference while the other three filaments are excited at phases of 90, 180 and 270° relative to the phase of the one filament used as a reference. The second quadrifilar helical antenna element 120 has its own feed network 190 for feeding its own filaments. The input power is distributed to the first feed network 180 through the power splitter/combiner 200. The input power is then fed to each of the four filament antenna feeds 170A, 170B, 170C, 170D and eventually to the four filaments 150A, 150B, 150C, 150D to be excited. The amount of power distributed to each filament feed may be varied depending on the transmission requirements.

The second quadrifilar helical antenna element 120 is not stationary but rather is rotated on its axis 210. The rotation of the second quadrifilar helical antenna element 120 produces a change in the phase of the helical element's radiation. The rotation is generated through a rotary drive system consisting of a drive means, such as a drive motor 220, with pulley means, such as a belt 230. The drive motor 220 attached to the belt 230 causes the second quadrifilar helical antenna element to rotate about its axis 210 by varying amounts. The amount of rotation required is ideally directly proportional to the amount of phase shift required and is related to the desired angular orientation of the resulting antenna beam. A flexible cable 240, coupled to the power splitter/combiner 200, provides a radio frequency (RF) connection with the second quadrifilar helical antenna element 120 through its feed network 190. A variety of other implementations are possible and well-known to a person skilled in the art. Coaxial rotary joints or coaxial waveguide joints coupled with flexible cables may be used to provide a suitable RF connection between a rotatable multi-filar helical antenna element and the power splitter/combiner.

Figure 3:
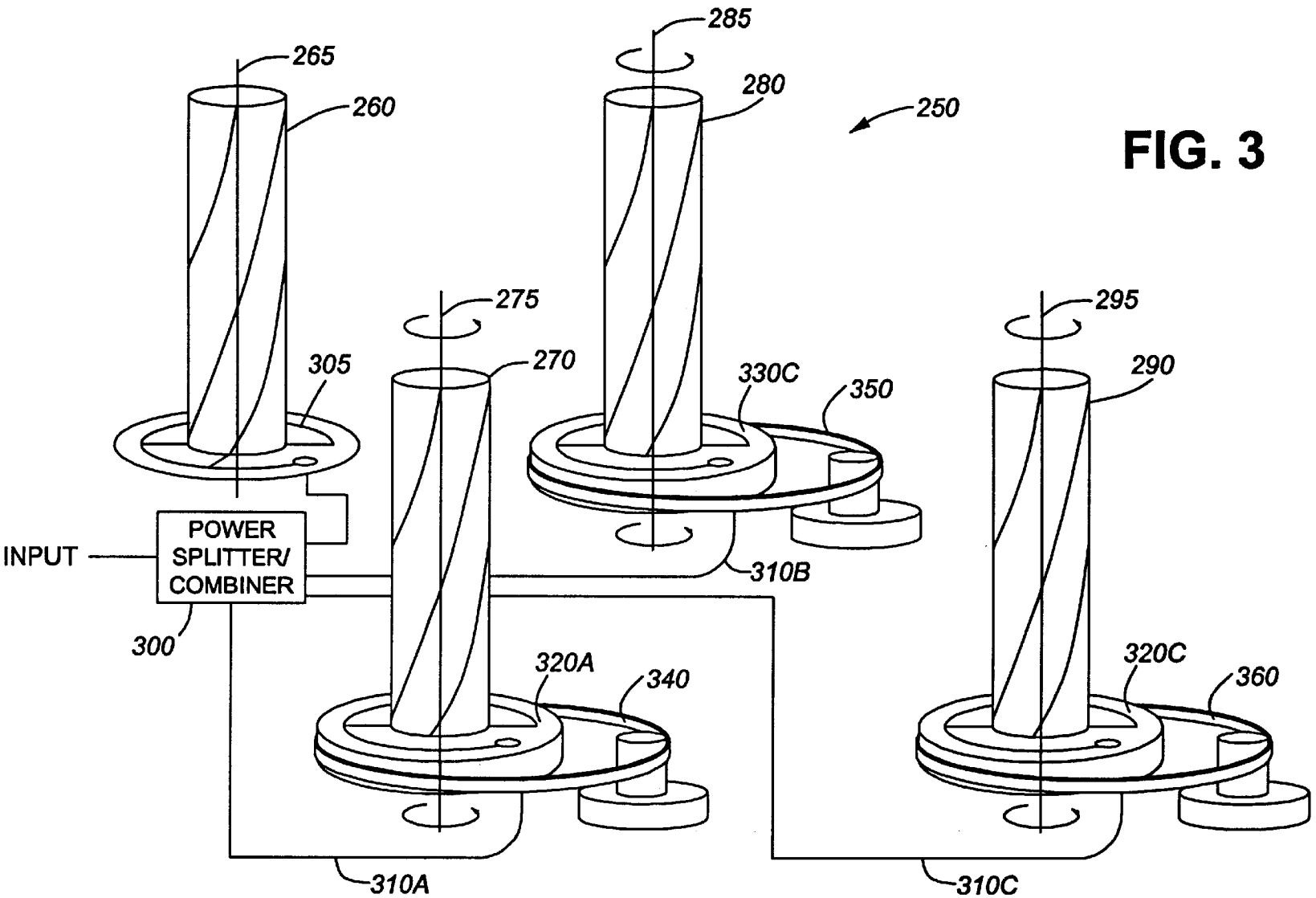
FIG. 3 shows a group of multi-filar helical antenna elements where several multi-filar helical antenna elements are each rotatable on their axes according to a second embodiment of the present invention.

FIG. 3 illustrates a phased-array antenna 250 according to the present invention. This phased-array antenna 250 is a two-dimensional array of helical antenna elements where a single quadrifilar helical antenna element 260 is stationary while the other three quadrifilar helical antenna elements 270, 280, 290 may be each turned on their respective axes 275, 285, 295. While the helical antenna element 260 is stationary, its conductive are wound about a common helical axis 265. The advantage of a two-dimensional array versus a one-dimensional array of two helical antenna elements, such as that illustrated in FIGS. 1 and 2, is that the beam of the two-dimensional phased-array antenna is narrow in all angular orientations. As a result, the narrow beam minimizes any interference from other sources and also increases the gain of the phased-array antenna.

According to the embodiment in FIG. 3, the power splitter/combiner 300 distributes the input power to all four helical antenna elements 260, 270, 280, 290. The power splitter/combiner 300 distributes power to the stationary helix element 260 through its own feed network 305 via a conventional RF connection. The three flexible cables 310A, 310B, 310C provide an RF connection between the power splitter/combiner 300 and the three feed network 320A, 320B, 320C respectively. The feed network 320A is coupled to the quadrifilar helical antenna element 270. The feed network 320B is coupled to the quadrifilar helical antenna element 280. As with the other two feed networks, the feed network 320C is coupled to the quadrifilar helical antenna element 290. Each of the three helical antenna elements 270, 280, 290 may be independently rotated by their rotary drive system according to the required antenna beam orientation. The quadrifilar helical antenna element 260 is rotated by the rotary drive system 340. The quadrifilar helical antenna element 280 is rotated by the rotary drive system 350. Similarly, the quadrifilar helical antenna element 290 is rotated by the rotary drive system 360. It should be mentioned that each quadrifilar helical antenna element may be rotated independently by varying amounts relative to other quadrifilar helical antenna elements. It is preferable that an antenna element is constructed such that a one degree rotation of the quadrifilar helical antenna element introduces a change of one degree in the phase of the radiated field.

While the explanation above contemplates uniform power distribution between the multi-filar helical antenna elements, this need not always be the case. For example, if low sidelobes are desired then the central array elements will receive more power than the outer elements. This non-uniform power distribution is most effective when there are more than four elements in the array.

Figure 4:
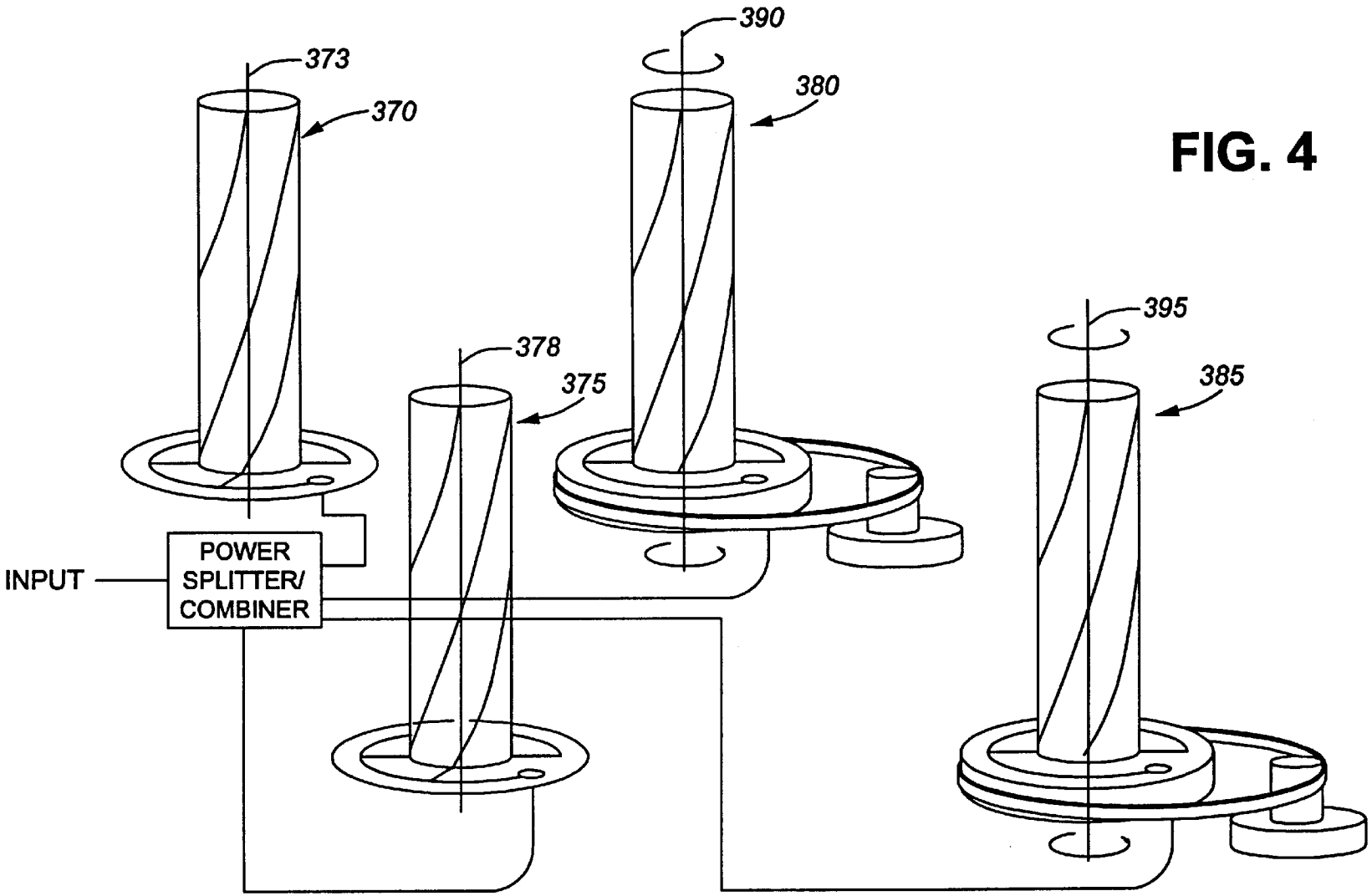
FIG. 4 shows a group of multi-filar helical antenna elements where a group of multi-filar helical antenna elements are rotatable on their axes according to a third embodiment of the present invention.

FIG. 4 illustrates a further variation of the present invention. Accordingly, two quadrifilar helical antenna elements 370, 375 remain stationary while another group of quadrifilar helical antenna elements 380, 385 are rotatable about their axes 390, 395. Both helical antenna elements 370, 375 have their respective axes 373, 378.

Figure 5:
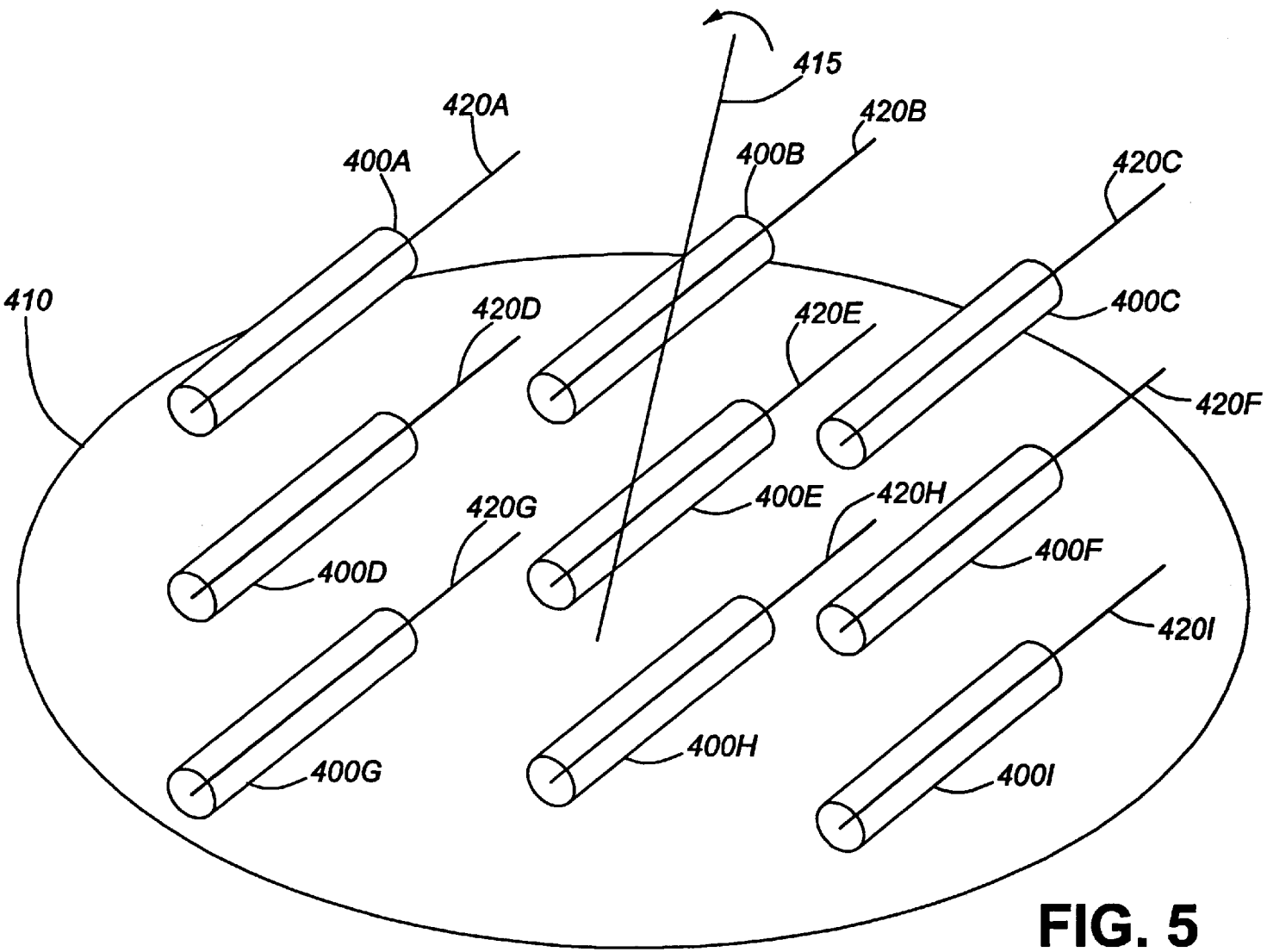
FIG. 5 shows an array of multi-filar helical antenna elements further rotatable on a base platter according to a third embodiment of the present invention.

FIG. 5 illustrates an array of helix elements 400A, 400B, . . . , 400I whose axes are oriented at approximately 45° relative to the plane of a base platter 410 of the array. The direction of the antenna beam scans in elevation from a direction parallel to the plane of the base platter 410 to a direction perpendicular to the plane of the base platter 410 by rotating the multi-filar helical antenna elements 400A, 400B, . . . , 400I. The base platter 410 is rotatable in azimuth about a predetermined base axis 415 to achieve full upper hemispherical coverage through the combination of the azimuth platter scan and elevation element scan. The predetermined base axis 415 may be collinear with a central axis of the base. According to this embodiment, the multi-filar helical antenna elements 400A, 400B, . . . , 400I can spin on their respective axes 420A, 420B, . . . , 420I in groups with each group having the same rotational settings. A central group may be used as a reference with only the outer groups rotating. Essentially, the antenna beam angular orientation along a plane perpendicular to the base plane is varied by adjusting the phase of one or more of the helical antenna elements. By orienting the helical antenna elements at a 45 degree angle relative to the base plane, the phase of the helical antenna elements need only be adjusted such that the beam is scanned by +/−45° from its rest position of 45° to the plane of the base platter 410. In order for the antenna beam to achieve full hemispherical coverage, the base platter must be rotated 360° in addition to varying the phase of the helical antenna elements. The base platter 410 may be rotated using several conventional techniques for rotating planar bases. The use of azimuth scanning of the platter along with elevation scanning by rotating the elements reduces the number of elements required in the array and makes the design less sensitive to roll-off (reduced gain) of the element pattern at the extreme scan positions.

Figure 6:
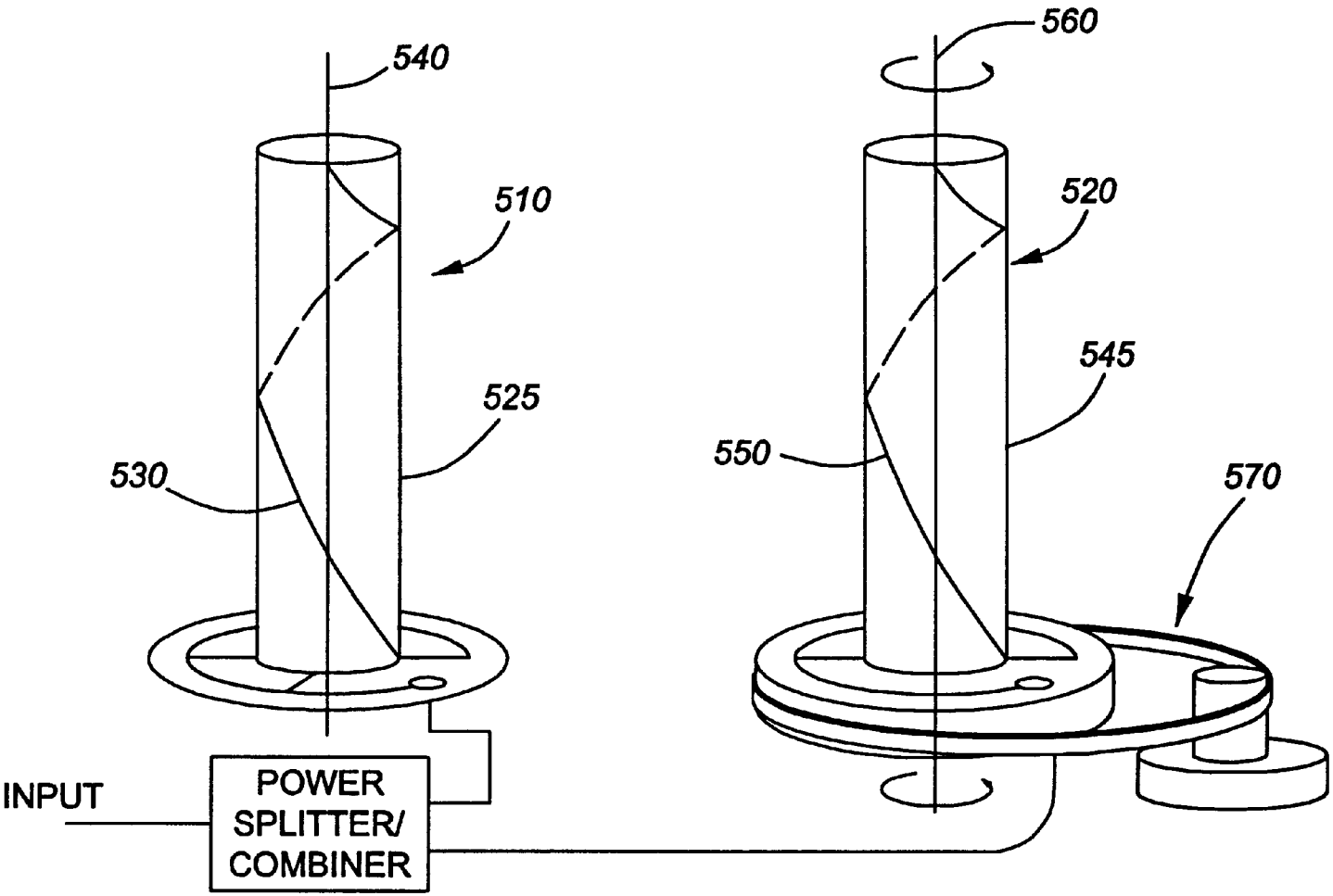
FIG. 6 shows two monofilar helical antenna elements with one element being rotatable on its axis according to a fourth embodiment of the present invention.

FIG. 6 illustrates a one-dimensional phased-array antenna 500 according to a fourth embodiment of the present invention. The antenna array consists of two monofilar helical antenna elements 510, 520. The first monofilar helical antenna element has a support tube 525 which supports a single conductive filament 530. The conductive filament is wound about its longitudinal axis 540 in a nominally helical trajectory. The second monofilar helical antenna element 520 has a support structure 545 which supports a conductive filament 550. The conductive filament 550 is wound about its longitudinal axis 560. While the helical antenna element 510 is stationary, the helical antenna element 520 is rotatable about its axis 560. The rotation of the helical antenna element is achieved as previously described in FIG. 2 through use of a rotary drive system 570.

Although FIG. 6 only illustrates an antenna system having two monofilar helical antenna elements, it is conceivable that there may be an array of stationary and rotatable monofilar helical antenna elements. These monofilar helical antenna elements may also be arranged on a base platter as shown in FIG. 5 such that the monofilar helical antenna elements are oriented at an angle relative to the base axis.

With respect to all the embodiments of the present invention, it is preferable that each helical antenna element be oriented with its axis at an angle between 10 and 90° relative to the base plane of the phased-array antenna or is offset by an angle between 10 and 80° relative to the central axis of the base.

The present invention may be further embodied as an antenna system attached to the fuselage of an aircraft for use in satellite communications. The phased-array antenna provides the aircraft full hemispherical coverage. This type of phased-array antenna is useful for providing the aircraft with voice and data communications. Furthermore, this phased-array antenna has a narrow beam which minimises interference from other satellites and provides high gain reception and transmission of voice and data.

The present invention may also be embodied as an antenna system mounted on a train locomotive or a truck for use in satellite communications.

A person understanding the above-described invention may now conceive of alternative designs, using the principles described herein. All such designs which fall within the scope of the claims appended hereto are considered to be part of the present invention.

What is claimed is:

1. An antenna system including:

(a) a base;

(b) at least one stationary multi-filar helical antenna element, the or each stationary multi-filar helical antenna element having a longitudinal axis, the or each stationary multi-filar helical antenna element having a first feed network coupled to a base end of the stationary antenna element, the first feed network having a feed end located at the base end of a corresponding stationary antenna element;

(c) at least one rotatable multi-filar helical antenna element, the or each rotatable multi-filar helical antenna element having a longitudinal axis, the or each rotatable multi-filar helical antenna element having a second feed network coupled to a base end of the antenna element, each second feed network having a feed end located at the base end of a corresponding rotatable antenna element, wherein the or at least one rotatable multi-filar helical antenna elements is rotatable on its longitudinal axis;

(d) at least one drive system connected to a corresponding one of the at least one rotatable multi-filar helical antenna elements, the at least one drive system being capable of rotating the corresponding at least one of the rotatable helical antenna elements about its longitudinal axis;

(e) a power splitting and combining means for feeding input power to each feed network belonging to each of the at least one stationary multi-filar helical antenna elements and the at least one rotatable multi-filar helical antenna element;

wherein the or each stationary antenna element is supported by the base at the base end of the stationary antenna element, wherein the or each rotatable antenna element is supported by the base at the base end of the rotatable antenna element, and wherein the power splitting and combining means feeds input power to the feed end of each first feed network and the feed end of each second feed network.

2. An antenna system as defined in claim 1, wherein the or each stationary multi-filar helical antenna element has a minimum operating frequency, and the or each stationary multi-filar helical antenna element has at least two conductive filaments, each conductive filament wound in a nominally helical trajectory, each conductive filament has an axial length of less than one free space wavelength at the minimum operating frequency, the conductive filaments having a common helical axis.

3. An antenna system as defined in claim 1, wherein the or each rotatable multi-filar helical antenna element has a minimum operating frequency, and the or each rotatable multi-filar helical antenna element has at least two conductive filaments, each conductive filament wound in a nominally helical trajectory, each conductive filament has an axial length of less than one free space wavelength at the minimum operating frequency, the conductive filaments having a common helical axis.

4. An antenna system as defined in claim 3, wherein the or each stationary multi-filar helical antenna element has a minimum operating frequency, and the or each stationary multi-filar helical antenna element has at least two conductive filaments, each conductive filament wound in a nominally helical trajectory, each conductive filament has an axial length of less than one free space wavelength at the minimum operating frequency, the conductive filaments having a common helical axis.

5. An antenna system as defined in claim 1, wherein the base is rotatable about a base axis, and the longitudinal axes of both the or each stationary multi-filar helical antenna element and the or each rotatable multi-filar helical antenna element is offset by an angle between 0 and 80° relative to the base axis.

6. An antenna system as defined in claim 5, wherein the base axis is collinear with a central axis of the base.

7. An antenna system as defined in claim 5, wherein the or each stationary helical antenna elements are oriented with its longitudinal axis at an angle of between 10 and 80° relative to a plane parallel to the base.

8. An antenna system as defined in claim 1, wherein the or each stationary multi-filar helical antenna element is a quadrifilar helical antenna element.

9. An antenna system as defined in claim 8, wherein the or each stationary multi-filar helical antenna elements and the or each rotatable multi-filar helical antenna elements forms a two-dimensional array on the base.

10. An antenna system as defined in claim 1, wherein the or each rotatable multi-filar helical antenna element is a quadrifilar helical antenna element.

11. An antenna system as defined in claim 1, wherein the or each rotatable helical antenna elements are oriented with its longitudinal axis at an angle of between 10 and 80° relative to a plane parallel to the base.

12. An antenna system as defined in claim 1, wherein the antenna system has an airborne application.

13. An antenna system as defined in claim 1, wherein the antenna system is used for satellite communications.

14. An antenna system including:

(a) a base;

(b) at least one stationary monofilar helical antenna element, the or each stationary monofilar helical antenna element having a longitudinal axis, the or each stationary monofilar helical antenna element having a first feed network coupled to a base end of the stationary antenna element, the first feed network having a feed end located at the base end of a corresponding stationary antenna element;

(c) at least one rotatable monofilar helical antenna element, the or each rotatable monofilar helical antenna element having a longitudinal axis, the or each rotatable monofilar helical antenna element having a second feed network coupled to a base end of the antenna element, each second feed network having a feed end located at the base end of a corresponding rotatable antenna element, wherein the or at least one rotatable monofilar helical antenna elements is rotatable on its longitudinal axis;

(d) at least one drive system connected to a corresponding of the at least one rotatable monofilar helical antenna elements, the at least one drive system being capable of rotating the corresponding at least one of the rotatable helical antenna elements about its longitudinal axis;

(e) a power splitting and combining means for feeding input power to each feed network belonging to each of the at least one stationary monofilar helical antenna elements and the at least one rotatable monofilar helical antenna element;

wherein the or each stationary antenna element is supported by the base at the base end of the stationary antenna element, wherein the or each rotatable antenna element is supported by the base at the base end of the rotatable antenna element, and wherein the power splitting and combining means feeds input power to the feed end of each first feed network and the feed end of each second feed network.

15. An antenna system as defined in claim 14, wherein the base is rotatable about a base axis, and the longitudinal axes of both the or each stationary monofilar helical antenna element and the or each rotatable monofilar helical antenna element is offset by an angle between 0 and 80° relative to the base axis.

16. An antenna system as defined in claim 15, wherein the base axis is collinear with a central axis of the base.

17. An antenna system as defined in claim 15, wherein the or each rotatable helical antenna elements are oriented with its longitudinal axis at an angle of between 10 and 80° relative to a plane parallel to the base.

18. An antenna system as defined in claim 14, wherein the or each stationary helical antenna elements are oriented with its longitudinal axis at an angle of between 10 and 80° relative to a plane parallel to the base.

19. An antenna system as defined in claim 14, wherein the or each stationary monofilar helical antenna elements and the or each rotatable monofilar helical antenna elements forms a two-dimensional array on the base.

* * * * *